US006763605B2

(12) United States Patent
Reddoch

(10) Patent No.: US 6,763,605 B2
(45) Date of Patent: Jul. 20, 2004

(54) CENTRIFUGAL DRILL CUTTINGS DRYING APPARATUS

(75) Inventor: Jeffrey Reddoch, Lafayette, LA (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/161,392

(22) Filed: May 31, 2002

(65) Prior Publication Data

US 2003/0221331 A1 Dec. 4, 2003

(51) Int. Cl.[7] ..... F26B 17/24

(52) U.S. Cl. ..... 34/58; 175/66; 175/206; 175/207

(58) Field of Search ..... 34/58; 210/369, 210/360.1, 380.1, 374, 377, 378, 770, 767, 790, 781, 787; 175/66, 206, 207, 209; 166/357, 267

(56) References Cited

U.S. PATENT DOCUMENTS 4,747,961 A * 5/1988 Beer et al. ..... 210/770
5,129,468 A * 7/1992 Parmenter ..... 176/66
5,256,289 A * 10/1993 Cope et al. ..... 210/369
5,435,917 A * 7/1995 Sato ..... 210/374
5,558,770 A * 9/1996 Cope et al. ..... 210/374
5,653,879 A * 8/1997 Schroeder ..... 210/298
5,667,681 A * 9/1997 Magrecki et al. ..... 210/374
6,170,580 B1 1/2001 Reddoch ..... 175/66
6,193,076 B1 * 2/2001 Hensley ..... 210/374
6,267,899 B1 * 7/2001 Greig et al. ..... 210/781
6,279,471 B1 8/2001 Reddoch ..... 100/37
6,432,299 B1 * 8/2002 Hensley et al. ..... 210/87

* cited by examiner

*Primary Examiner*—Henry Bennett
*Assistant Examiner*—Camtu Nguyen
(74) *Attorney, Agent, or Firm*—Madan, Mossman & Sriram, P.C.

(57) ABSTRACT

A vertical, centrifugal separator used for drying drill cuttings prior to transport or further processing. The separator is adapted to receive scavenged heat from any source and is further adapted to include internal conveyers, thereby lowering the overall operating profile and providing increased cuttings retention time within a heated environment.

10 Claims, 3 Drawing Sheets

CENTRIFUGAL DRILL CUTTINGS DRYING APPARATUS

BACKGROUND OF THE INVENTION

1. Field of the Invention

This invention relates generally to Vertical Centrifugal Separators and more particularly to improvements made to such a Centrifugal Separator to improve its performance in drying oil and gas well cuttings in an offshore environment.

2. General Background

Oily drill cuttings often cannot be discharged directly into the environment due to their adverse effect upon the environment and, therefore, must be processed for disposal in costly disposal wells. Additionally, because of the great value of the residual oil and chemicals contained in them, it has been a common practice to treat the oil drill cuttings in order to produce a solid material that can be disposed into the environment surrounding the well site or returned into the well from which it came without injury to the environment or interference with the well. One method of treating these oily drill cuttings has been through the use of a chemical washing system. In this system, the oily drill cuttings are treated with various chemicals, including detergents, with relatively intense mixing. Then, this mixture is resolved into relatively oil-free solids (i.e., the drill cuttings) and a recovered liquid phase which is a mixture of water, oil, and the detergents which were employed in the chemical wash system. Burial or re-injection then disposes of the solids. However, these solids may still contain sufficient oil and/or chemicals that, upon contact with bodies of water, such as surface waters, lakes or the ocean, produce unacceptable levels of toxins detrimental to preserving the environment in the best possible form. In addition, the liquid phase must be treated to separate the oil from the bulk water phase so that the water portion can be discharged or otherwise disposed without pollution problems. The separated oil and expensive drilling fluids are usually recovered and utilized for various uses such as fuel or be returned into the blending of additional oil based drilling muds and the like.

Examples of the chemical wash system are described in U.S. Pat. Nos. 2,266,586, 3,860,019, and 3,766,997. Various other systems have been proposed for removing excess residue and chemicals from drill cuttings and transforming them into a solid material that can be returned to the surface environment or injected into the earth formation. For example, various thermal systems for flashing off the oily residue from the drill cutting solids through the use of thermal incineration have been proposed. An example of such incineration is described in U.S. Pat. Nos. 3,693,951, 2,266,586 and 4,139,462. The cuttings are heated to elevated temperatures above 500 degrees Fahrenheit for extended periods of time. Then, these heated cuttings are moved through a chamber until all the volatile materials are vaporized to leave an oil-free solids residue which could be disposed safely in the environment. This thermal procedure is relatively expensive in that it requires large amounts of an inert gas to prevent internal explosions by the contact with air of the heated solids at excessive temperatures. The relatively large amounts of the inert gas complicate the recovery of liquid materials from the chamber because of the undesired high levels of gas flow into condensers and the like. The greatest disadvantage in this particular procedure for treating oily drill cuttings is the danger of explosions in the system should air or other oxidizing gas enter into contact with the heated oil vapors produced by the excessive heating of the oily drill cuttings. Should the flow of inert gas be terminated through accident or inadvertence, air entering in contact with these oily vapors could produce a very serious explosion and fire. Such an arrangement is not acceptable in the area surrounding an oil well, especially while it is being drilled.

The above described prior art procedures for treating oily drill cuttings have other serious disadvantages, especially when they are to be employed on offshore drilling platforms. For example, large amounts of chemicals must be transported at great expense to offshore facilities. In addition, these offshore platforms do not have any surplus of steam, gas, electrical, or other energy sources. Thus, a procedure for treating the oily drill cuttings must be self-sufficient relative to the operations on the offshore platforms. In addition, the treatment procedure for the oily drill cuttings must be safe to operate, not require extensive retention time, operate without interference or hindrance to the drilling operations conducted on the offshore platform, while yet producing solids from the drill cuttings which can be disposed of safely and without any injury to the environment at the drilling site. In addition, the system for the treatment of oily drill cuttings at the drilling site, and especially on an offshore platform, must not require a constant supply of chemicals, fuel, nitrogen or other materials for its operation.

In addition, drying systems must meet stringent regulations that may effect the use of such equipment on an offshore platform where space is at a premium. Regulations dictate that equipment provided for use on offshore facilities after design and construction of the facility must meet certain height and weight restrictions in accordance with the equipment location. Such restrictions serve to induce equipment manufacturers to produce equipment with the lowest possible footprint with emphasis on efficiency.

It has been found that drill cuttings need not necessarily be incinerated to remove and recover residual cutting oils and expensive chemicals. Such oils and chemicals are routinely being removed and recovered by compression and separation as demonstrated by U.S. Pat. Nos. 6,279,471 and 6,170,580. However, it is still advantageous for the cuttings to be as dry as possible for transport and further processing for injection into the earth formation.

As discussed above, the drying operation for drill cuttings is a secondary operation of the separator system in which the primary consideration is to remove the liquids and render the residual oils and chemicals harmless to the environment through incineration. In cases where further processing of the drill cuttings prior to discharge or transport is still required, complete removal of the residual residue is unnecessary and drying the cuttings to improve handling, transport and further treatment becomes the primary objective. It is therefore essential that the most efficient method for drying drill cuttings be found.

Centrifugal separators are widely used as a very efficient method for separating fluids from solids. However, they are not generally considered to be driers and are not generally configured with any form of heat ducts due to the relatively low retention time of the materials passing through the separator.

In general, vertical, centrifugal separators such as is described in U.S. Pat. No. 5,256,289 include a housing containing a drive mechanism to which is connected both a flight assembly and a screen assembly. The separator further includes an inlet for induction of the material to be separated. Induced material is captured by the flight screen assembly, separation occurring as the material migrates downwardly with liquids or very small particles present on or in the material being forced outwardly through a fine screen into a space between the screen and the housing by centrifugal force. The majority of the liquids are then drawn off and the solids are generally ejected from an outlet assembly located below the rotor drive assembly. The outlet assembly usually is defined as a conical discharge bin for depositing the solids in a container or further conveyed to other locations for disposition, thereby making the dryer quite high.

The present dryer system utilizes a centrifugal separator as a dryer and is arranged to satisfy all of the requirements for use in connection with its adaptation to oil well drilling and especially in connection with its placement upon an offshore platform without the disadvantages of the prior art and, in addition, providing for self-sufficient operation with minimum operator attention and absolute fail-safe operation.

SUMMARY OF THE INVENTION

The present invention utilizes a vertical, centrifugal separator for drying drill cuttings prior to transport or further processing. The separator is adapted to receive scavenged heat from any source and is further adapted to include internal conveyers, thereby lowering the overall operating profile and increasing cuttings retention time within a heated environment.

BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

DETAILED DESCRIPTION OF THE PREFERRED EMBODIMENT

Figure 4:
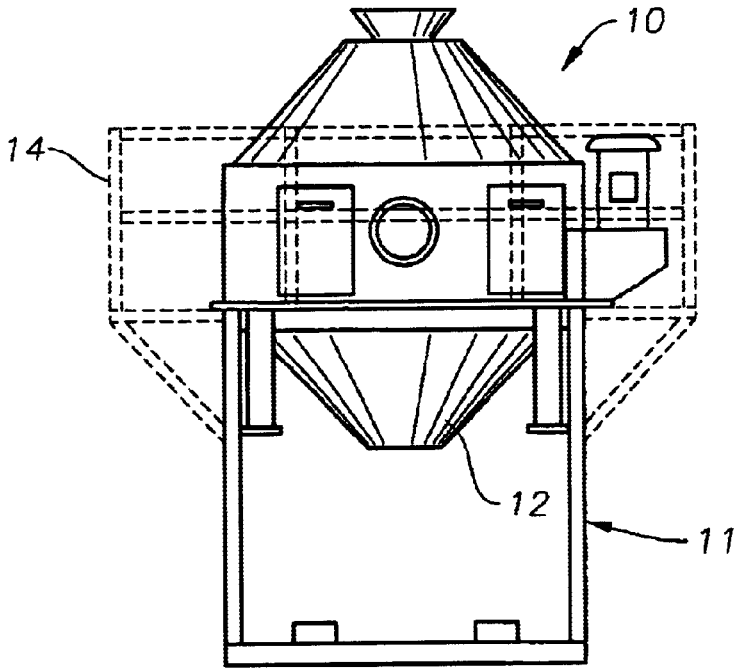
FIG. 4 is vertical front elevation view of a conventional vertical, centrifugal separator with platform and discharge bin.
Figure 5:
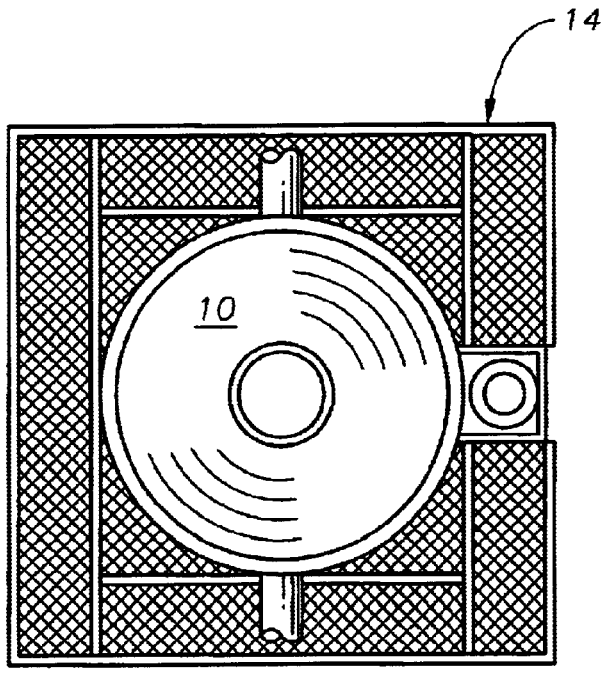
FIG. 5 is a top view of the vertical centrifugal separator illustrated in FIG. 4.

Typically a conventional vertical, centrifugal separator 10 may be adapted for use in separating fluids and fine solids from drill cuttings by simply elevating the separator 10 on a frame 11 in a manner whereby solids may be discharged into a collection or transport container (not shown) located directly underneath conical discharge bin 12 attached to the underside of the separator 10 as illustrated in FIG. 4. Usually a walkway 14 is arranged around the circumference of the separator 10 for maintenance and servicing as shown in FIGS. 4 and 5. This arrangement, although useful in applications such as onshore drilling platforms, is not appropriate for offshore operations due to the required overall height and the need to convey drill cuttings to other locations on the drill platform.

Figure 1:
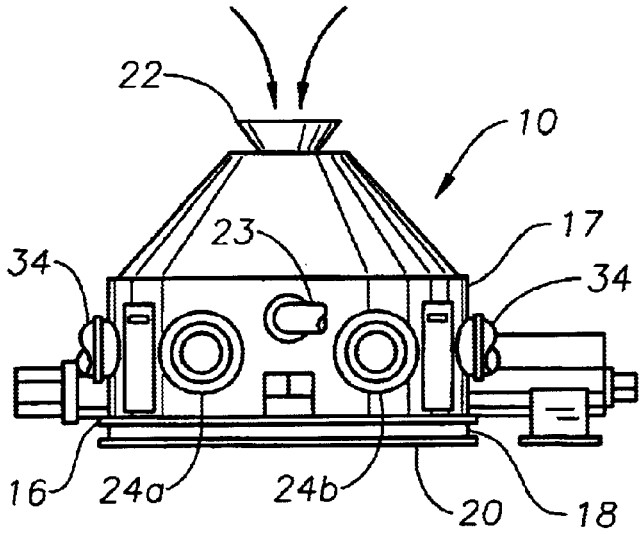
FIG. 1 is a vertical front elevation view of the preferred embodiment.

Offshore drilling operations conducted from stationary or floating platforms often have very limited equipment space. Therefore, it is essential that each piece of equipment be as compact and efficient as possible. As seen in FIG. 1, a vertical, centrifugal separator 10 has a relatively low profile in its basic form without any form of discharge or collection bins attached thereto for discharging the solids in a controlled manner and/or depositing them in a conveyer or a container as seen in FIG. 4. As seen in FIG. 1, the separator 10 may be mounted directly to a deck by way of the housing flange 16 extending circumferentially around the base of the separator 10. However, extending the housing 18 and adding a second flange 20 may adjust overall height of the separator. A plate may be secured to the base flange 16 of the separator 10 in a manner whereby the base of the separator is effectively closed.

Figure 2:
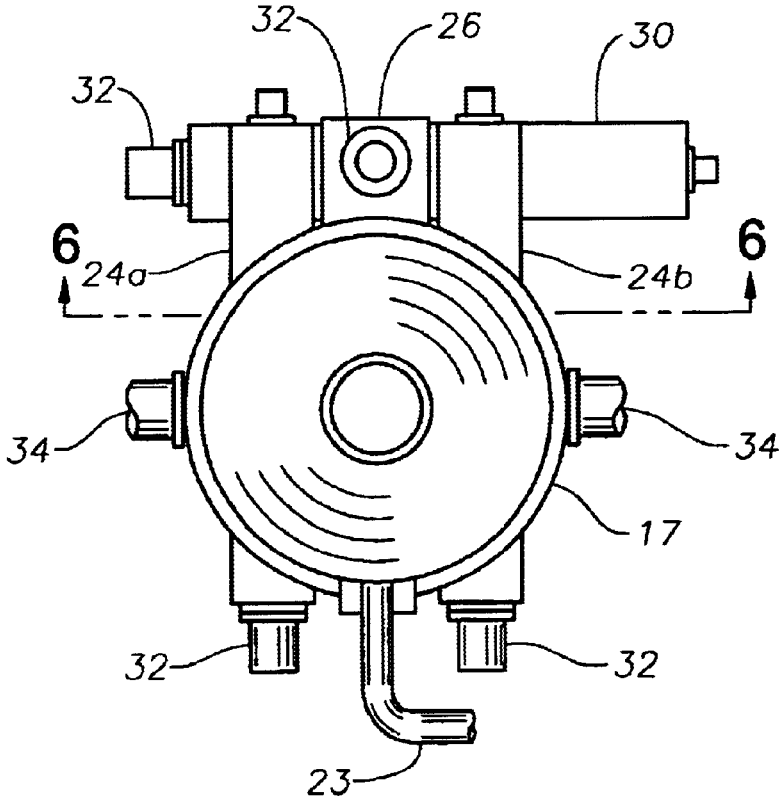
FIG. 2 is a top view of the preferred embodiment.

A slurry or stream of semi-dry drill cuttings may be conveyed in some manner to the separator 10 and deposited into the conical opening 22 at the top of the separator where any liquids are removed by centrifugal force and discharged through outlet 23. Since it is essential that some way of removing the separated solids be provided and it is desirable to maintain the lowest possible separator profile, a pair of screw conveyors 24*a*, 24*b* may be added. The conveyors 24*a*, 24*b* penetrate both walls of the separator housing 17 as seen in FIG. 2, extending on each side and parallel to the drive housing 26 located on the vertical centerline and the diametrical center of the separator 10 and extending outwardly through the separator housing 17 and forming a support for the external drive motor 32. The internal screw conveyors 24*a*, 24*b* feed the dry solid cuttings to a collection conveyor 30 located externally and connected perpendicular to one end of each of the internal conveyors 24*a*, 24*b*. However, the collecting conveyor may be replaced by any solids collecting system such as pressure or vacuum systems used to transfer the dry cuttings to other locations on the drill platform for further processing, transport or discharge to the environment.

External drive motors 32 drive each of the internal screw conveyors 24*a*, 24*b* and the collection conveyor.

As indicated herein, the drying of the drill cuttings is of primary importance. However, it is not essential the cuttings be incinerated to remove all residual oils and/or chemicals remaining on or in the cuttings. Therefore, the thermal energy need not exceed 500 degrees Fahrenheit. Sources for thermal energy within this temperature range may be readily scavenged from heat exchangers, engine heat exhaust vents, etc., normally available on the drilling platform. Heat may be accumulated in insulated heat recovery manifolds and piped into the heat ducts 34 located on the sides walls of the separator, seen in FIG. 3 located between inspection panels 36 and also seen in FIG. 2.

Figure 3:
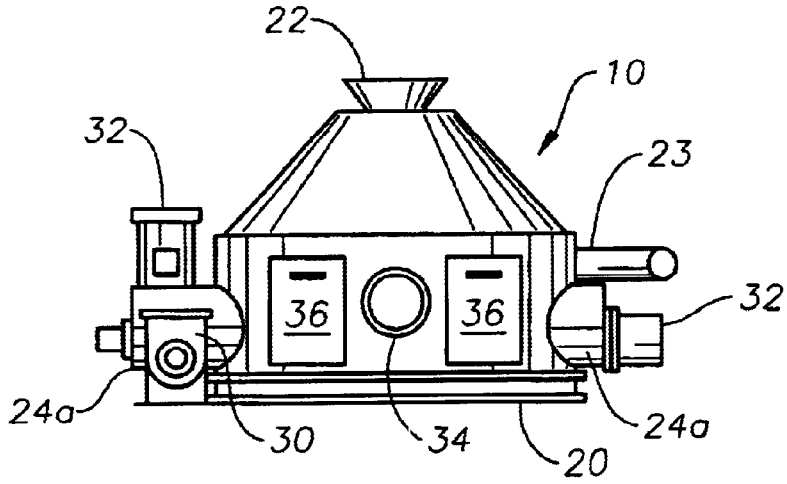
FIG. 3 is a side elevation view of the preferred embodiment.
Figure 6:
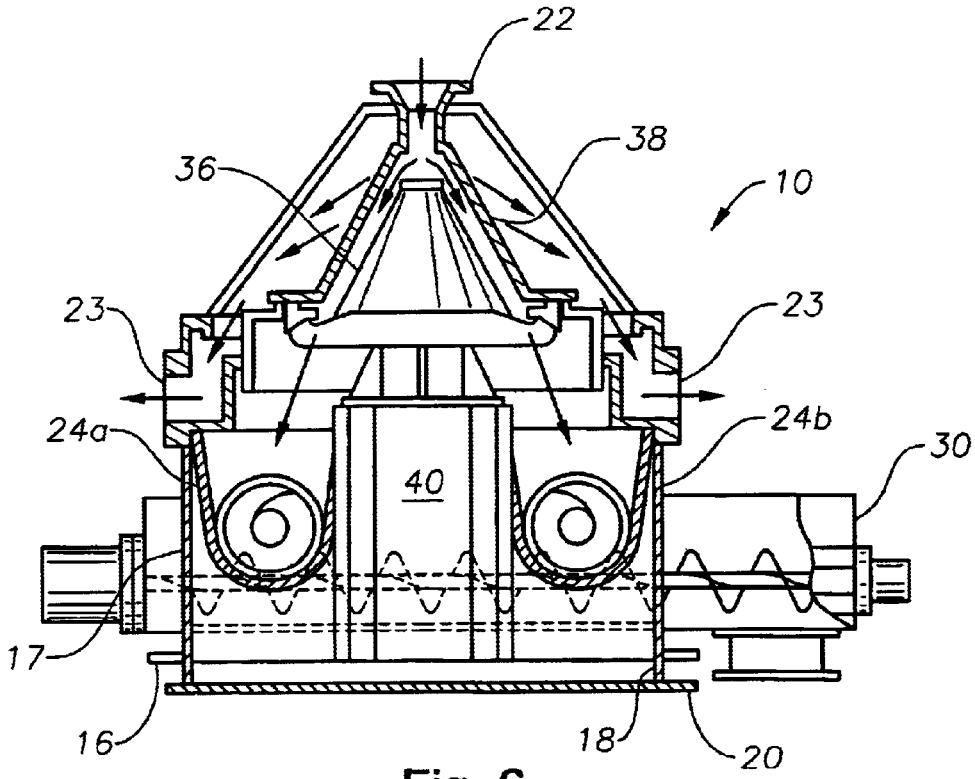
FIG. 6 is a cross section view of the preferred embodiment taken along sight line 6—6 seen in FIG. 2.

Looking now at FIG. 6 we see that, in operation, the slurry or semi-dry cuttings enter the separator 10 through the top funnel 22 and migrate downwardly between the rotating cone 36 and the stationary screen 38 where centrifugal force slings the liquid and fine particles through the screen 38 and ultimately discharges them through one or more ports 23 located around the perimeter of the separator 10. Solids not passing through the screen 38 are deposited in the screw conveyors 24*a*, 24*b* located on each side of the drive housing 40 enclosing the rotating cone's drive pulley and extending outwardly though the separator wall 17. Baffling extending from and between the conveyor troughs is provided to collect and direct the solids into the conveyors 24*a*, 24*b*. Inspection doors may be relocated to provided access to the drive housing 40 to allow servicing of the drive. As seen in FIG. 3, the heat ducts 34 installed in the separator walls 17 would necessarily be located below the conveyors 24*a*, 24*b*.

Therefore, heat transfer to the solids is by thermal heat exchange from solids contact with the heated conveyor troughs. Back-pressure vents located in the separator walls 17 may also be provided if necessary to provide an exhaust port.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A drill cutting dryer apparatus for offshore drilling platforms comprising:

a) a vertical, centrifugal separator having a vertical inlet and a conical separator screen;

b) at least one liquids discharge port;

c) a base mounting flange defining a solids discharge opening; and d) at least one screw conveyor located integral with said separator in a manner whereby said conveyer is located above said discharge opening and does not contribute to the overall height of said separator.

2. The drill cuttings dryer according to claim 1 wherein said separator further comprises heat induction means.

3. The drill cuttings dryer according to claim 1 wherein said separator further comprises a means for extending the height of the separator.

4. The drill cuttings dryer according to 3 wherein said means for extending the height comprise a housing extension and flange member.

5. The drill cuttings dryer according to claim 1 wherein said separator further comprises a collection screw conveyer attached in a perpendicular manner located externally of and in communication with said screw conveyor located integral with said separator.

6. The drill cuttings dryer according to claim 1 wherein said separator further comprises baffles for directing solids into said conveyer located integral with said separator.

7. The drill cuttings dryer according to claim 2 wherein said induction heat is scavenged from non-related existing sources of heat producing equipment.

8. A drill cuttings dryer apparatus for offshore drilling platforms comprising:

a) a vertical, centrifugal separator having a conical separator screen and a plurality of liquid discharge pods;

b) an external housing having a base flange defining a solids discharge opening;

c) a drive housing centrally located about the vertical centerline of said separator and extending outwardly in a perpendicular manner through said external housing and further supporting an external drive motor;

d) a screw conveyor located adjacent each side of said drive housing extending through said external housing and located integral with said separator above said base flange; and e) a collecting screw conveyor located externally of said separator attached perpendicular to an end of said screw conveyor.

9. The drill cuttings dryer apparatus for offshore drilling platforms according to claim 8 further comprising a means for scavenging waste heat from existing equipment and inducting said heat into said separator.

10. A method of drying drill cuttings comprising the steps of feeding said drill cuttings into a vertical, centrifugal separator having integral screw conveyors, discharging fluids separated from said cuttings, subjecting said cuttings internally to heat collected from a plurality of waste heat sources, collecting said cuttings in said integral screw conveyors and discharging said cuttings in a dried condition to an external collecting and transfer means for discharging said cuttings at other locations on the drill platform.

* * * * *